US009067412B2

(12) United States Patent
Yamanaka et al.

(10) Patent No.: US 9,067,412 B2
(45) Date of Patent: Jun. 30, 2015

(54) PRINTING APPARATUS AND METHOD OF CORRECTING STEP SHIFT THEREOF

(71) Applicant: DAINIPPON SCREEN MFG. CO., LTD., Kyoto (JP)

(72) Inventors: Kazuki Yamanaka, Kyoto (JP); Seiya Nomura, Kyoto (JP)

(73) Assignees: SCREEN Holdings Co., Ltd. (JP); Ricoh Company, Ltd. (JP)

( * ) Notice: Subject to any disclaimer, the term of this patent is extended or adjusted under 35 U.S.C. 154(b) by 0 days.

(21) Appl. No.: 14/283,914

(22) Filed: May 21, 2014

(65) Prior Publication Data

US 2015/0091963 A1 Apr. 2, 2015

(30) Foreign Application Priority Data

Sep. 30, 2013 (JP) ..... 2013-204086

(51) Int. Cl.
*B41J 29/38* (2006.01)
*B41J 2/07* (2006.01)

(52) U.S. Cl.
CPC ..... *B41J 2/07* (2013.01)

(58) Field of Classification Search
CPC . H04N 1/1903; H04N 1/1911; B41J 2/04573; B41J 2/515; B41J 3/543; B41J 2/2146; B41J 29/393; B41J 2/04505; B41J 2/2132; B41J 2/2135
USPC ..... 347/9–12, 14–16, 19, 40–41, 43
See application file for complete search history.

(56) References Cited

U.S. PATENT DOCUMENTS

| | | | | |
|---|---|---|---|---|
| 7,216,948 | B2 * | 5/2007 | Matsuzaki et al. | 347/14 |
| 8,641,164 | B2 * | 2/2014 | Kondo et al. | 347/19 |
| 2005/0062784 | A1 | 3/2005 | Matsuzaki et al. | 347/19 |
| 2010/0039470 | A1 | 2/2010 | Suzuki | 347/14 |

FOREIGN PATENT DOCUMENTS

| | | |
|---|---|---|
| JP | 2010-042629 | 2/2010 |
| JP | 2010-094929 | 4/2010 |

OTHER PUBLICATIONS

Extended European Search Report dated Aug. 6, 2014 issued in corresponding European Patent Application No. 14170255.5.

* cited by examiner

*Primary Examiner* — Thinh Nguyen
(74) *Attorney, Agent, or Firm* — Ostrolenk Faber LLP

(57) ABSTRACT

A printing apparatus performing printing to a print medium includes a printer having at least two line heads with a plurality of recording modules; a scanner configured to scan an image printed with the printer to obtain a scanned image; a correcting-chart printing unit configured to print first and second correcting charts in first and second line head printing areas, respectively; a scanned image collecting unit configured to collect first and second scanned images; a correction-data calculating device configured to calculate correction data by determining a reference head difference from the first scanned image, determining an individual head difference from the second scanned image, summing up the reference head difference and the individual head difference to obtain a total, the reference head difference and the total being regarded as the correction data for the first and second line heads, respectively; and an adjusting device configured to adjust a timing.

10 Claims, 7 Drawing Sheets

PRINTING APPARATUS AND METHOD OF CORRECTING STEP SHIFT THEREOF

TECHNICAL FIELD

The present invention relates to a printing apparatus configured to correct step shift as printing shift in a transportation direction of a print medium, and a method of correcting the step shift.

BACKGROUND ART

Examples of such a conventional apparatus include an inkjet printing apparatus having an inkjet printing head, an inspecting unit, and a controller. See, for example, Japanese Patent Publication No. 2010-42629A.

The inkjet printing head is constituted by a plurality of printing modules arranged in a width direction (primary scanning direction) of web paper, the width direction being orthogonal to a transportation direction of the web paper. Moreover, in a construction for color printing, printing heads for black (K), cyan (C), magenta (M), and yellow (Y) are arranged in this order from upstream in the transportation direction of the web paper.

The controller controls the printing heads so as to print a correcting chart onto the web paper, and capture the correcting chart while locating the correcting chart at the inspecting unit. Thereafter, the controller determines step shift of the printing head for black (K) in the transportation direction in accordance with the correcting chart, thereby determining correction data for correcting the step shift. Then, the controller applies the correction data upon printing with the printing head for black (K) to print the correcting chart with the step shift eliminated therefrom at three portions of the web paper. In addition, the printing heads for cyan (C), magenta (M), and yellow (Y) print correcting charts, respectively, on the three correcting charts for each color printed with the printing head for black (K). Thereafter, the correcting charts for three colors are captured with the inspecting unit. The controller determines the step shift of the printing heads for each color relative to the printing head for black (K) in the transportation direction, and determines the correction data for correcting a shift amount for each color in the transportation direction.

As noted above, the controller determines the step shift in the transportation direction of the printing head for black (K) only at a first correcting chart, and determines correction data for correcting the step shift. Thereafter, the controller determines the step shift in the transportation direction of the printing heads for each color relative to the printing head for black (K) by printing a second correcting chart for step-shift correction. Then, the controller determines correction data for correcting the step shift. In this manner, the step shift of the printing heads for every color upon printing is eliminated.

However, the example of the conventional apparatus with such a construction has the following drawback.

That is, the conventional apparatus needs two-time printing of the correcting chart, causing a low acquiring efficiency of the correction data for correcting the step shift. Such a problem may arise. The low acquiring efficiency causes more time to start printing of products, leading to decreased availability of the apparatus. Consequently, enhancing acquiring efficiency is an important task.

SUMMARY OF INVENTION

Additional features of the invention will be set forth in the description which follows, and in part will be apparent from the description, or may be learned by practice of the invention.

The present invention has been made regarding the state of the art noted above, and its object is to provide an inkjet printing apparatus that allows efficient acquisition of correction data by designing determination of the correction data, and to provide a method of correcting step shift of the apparatus.

In order to accomplish the above object, the present invention adopts the following construction.

One embodiment of the present invention is a printing apparatus configured to perform printing to a print medium. The printing apparatus includes a printer having at least two line heads spaced away in a transportation direction of the print medium, the line heads each having a plurality of recording modules with a train of recording devices arranged linearly in a width direction of the print medium; a scanner configured to scan an image printed with the printer to obtain a scanned image; a correcting-chart printing unit configured to cause a first line head of the printer to print a first correcting chart in a first line head printing area and cause the first line head to print the first correcting chart and causes a second line head to print a second correcting chart in a second line head printing area, away from the first line head printing area in the transportation direction; a scanned image collecting unit configured to operate the scanner to read the first line head printing area and the second line head printing area to collect a first scanned image and a second scanned image, respectively; a correction-data calculating device configured to calculate correction data; and an adjusting device configured to adjust a timing in accordance with the correction data upon printing with the printer. The correction-data calculating device regards a line figure in the first scanned image formed with one of the plurality of recording modules as a reference line figure, and determines a difference in the transportation direction between the reference line figure and a line figure formed with the other recording module as a reference head difference, determines a difference in the transportation direction between a first line figure and a second line figure of the second scanned image as an individual head difference, the first line figure being formed with the first line head and the second line figure being formed with the second line head, and sums up the reference head difference and the individual head difference to obtain a total for every recording module, the reference head difference being regarded as the correction data in the transportation direction for every recording module in the first line head, and the total being regarded as the correction data for every recording module in the second line head With the embodiment of the present invention, the correcting-chart printing unit prints the first correcting chart in the first line head printing area, and prints the second correcting chart in the second line head printing area. The scanned image collecting unit collects the areas as the first scanned image and the second scanned image, respectively. The correction-data calculating device adopts the line figure of the first scanned image formed with one of the recording modules as the reference lined figure, and determines the difference in the transportation direction between the reference line figure and the other line figure formed with the other recording module, thereby obtaining the result as the reference head difference. In addition, the correction-data calculating device determines the difference in the transportation direction between the first line figure and the second line figure of the second scanned image formed with the first line head and the second line head, respectively, to obtain the result as the individual head difference. Then, the correction-data calculating device sums the reference head difference and the individual head difference for every recording module. Each the reference head difference is regarded as the correction data in the transportation direction for every recording module in the first line head. Each the total containing the reference head difference is regarded as the correction data for every recording module. The adjusting device adjusts the timing upon the printing with the printer in accordance with the correction data. Consequently, the correction data is obtainable through one-time printing. This achieves an enhanced acquiring efficiency of the correction data.

Moreover, the correcting-chart printing unit according to the embodiment of the present invention preferably performs printing of the line figure of the first correcting chart for every recording module and the line figure of the second correcting chart for every recording module in the second line head printing area by a length in the width direction of the print medium such that the line figures printed at the same position in the transportation direction do not overlap each other.

The line figure of the first correcting chart and that of the second correcting chart each have a length such that they do not overlap each other when they are printed at the same position in the transportation direction. Consequently, no detection of the difference is avoidable.

Moreover, the correcting-chart printing unit according to the embodiment of the present invention prints the line figures of the first correcting chart and the second correcting chart in the second line head printing area so as to be spaced away from each other in the transportation direction with a portion other than the recording module used upon printing the line figures. The correction-data calculating device calculates the individual head difference by averaging step shift, the step shift being determined from the line figures of the first and second correcting charts in the second line head printing area for every recording module. Such is preferable.

A train of recording devices in the line head is not linear in the width direction due to machining accuracy, and thus shifting occurs in the transportation direction. Accordingly, when the individual head difference is determined from only the difference between the first and second correcting charts printed with a part of the train of recording devices in the line head, an error from the shifting may possibly increase. Then, the individual head difference is determined by averaging the difference in the transportation direction of the first and second correcting charts printed with the train of recording devices in a part of the line head and the difference in the transportation direction between the first and second correcting charts printed with the remaining part of the train of recording devices in the line head. This achieves suppressed influence of the error due to the shifting. As a result, an accurate individual head difference is obtainable.

Moreover, the first line head of the printer preferably performs printing prior to the second line head. The reference line figure is preferably printed with one of the plurality of recording modules that performs first printing.

Here, the first line head that performs prior printing or the recording module that performs first printing is referred. Consequently, the other line heads or recording modules are readily aligned.

Moreover, in the embodiment of the present invention, when the recording module includes a plurality of trains of recording devices, each of the trains of recording devices subsequent to the second train in the first line head is preferably regarded as the second line head.

Even with the printer enhancing resolution by a plurality of trains of recording devices, when each of the trains of recording devices subsequent to the second train in the first line head is regarded as the second line head, correction data similar to that with one train of recording devices is obtainable.

Another embodiment of the present invention is a method of correcting step shift of a printing apparatus configured to perform printing to a print medium. The method includes a correcting-chart printing step of printing a first correcting chart with a first line head of a printer onto a first line head printing area and printing onto a second line head printing area, spaced away from the first line head printing area in a transportation direction, the first correcting chart being printed with the first line head and a second correcting chart being printed with a second line head; a scanned-image collecting step of reading the first line head printing area and the second line head printing area to collect a first scanned image and a second scanned image, respectively; a correction-data calculating step of calculating correction data; and an adjusting step of adjusting a timing in accordance with the correction data upon printing with the printer. The correction-data calculating step is performed by regarding a line figure in the first scanned image formed with one of the plurality of recording modules as a reference line figure, and determining a difference in the transportation direction between the reference line figure and a line figure formed with the other recording module as a reference head difference, determining a difference in the transportation direction between a first line figure and a second line figure of the second scanned image formed with the first line head and the second line head, respectively as an individual head difference, summing up the reference head difference and the individual head difference for every recording module, regarding each the reference head difference as the correction data in the transportation direction for every recording module in the first line head, and regarding each of the sum as the correction data in the second line head for every recording module.

In the embodiment of the present invention, in the correcting-chart printing step, the first correcting chart is printed onto the first line head printing area, and the second correcting chart is printed onto the second line head printing area. In the scanned-image collecting step, the charts are collected as the first and second scanned images. In the correction-data calculating step, the line figure of the first scanned image formed with one recording module is regarded as the reference line figure, and the difference in the transportation direction between the line figure and the line figure formed with the other recording module is regarded as the reference head difference. In addition, in the correction-data calculating step, the difference in the transportation direction between the first and the second line figures of the second scanned image formed with the first and the second line heads, respectively, is regarded as the individual head difference. Then, in the correction-data calculating, the reference head difference and the individual head difference are summed up for every recording module, the reference head difference is regarded as the correction data in the transportation direction for every recording module in the first line head, and the sum containing the reference head difference us regarded as the correction data for recording module. In the adjusting step, the timing is adjusted in accordance with the correction data upon printing with the printer. Consequently, the correction data is obtainable through one-time printing. This achieves an enhanced acquiring efficiency of the correction data.

It is to be understood that both the foregoing general description and the following detailed description are exemplary and explanatory and are intended to provide further explanation of the invention as claimed.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

Figure 1:
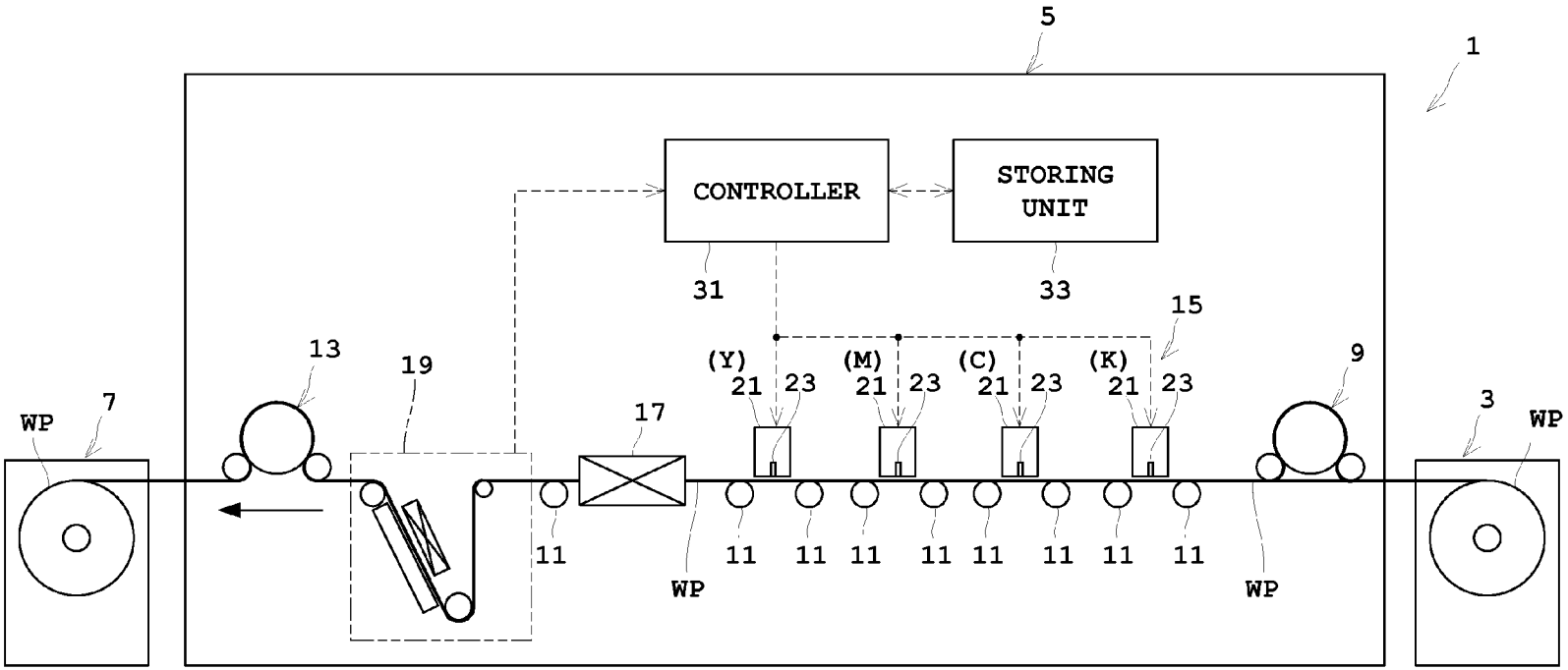
FIG. 1 schematically illustrates an overall construction of an inkjet printing apparatus according to one embodiment.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

The following describes one example of the present invention with reference to drawings.

Figure 2:
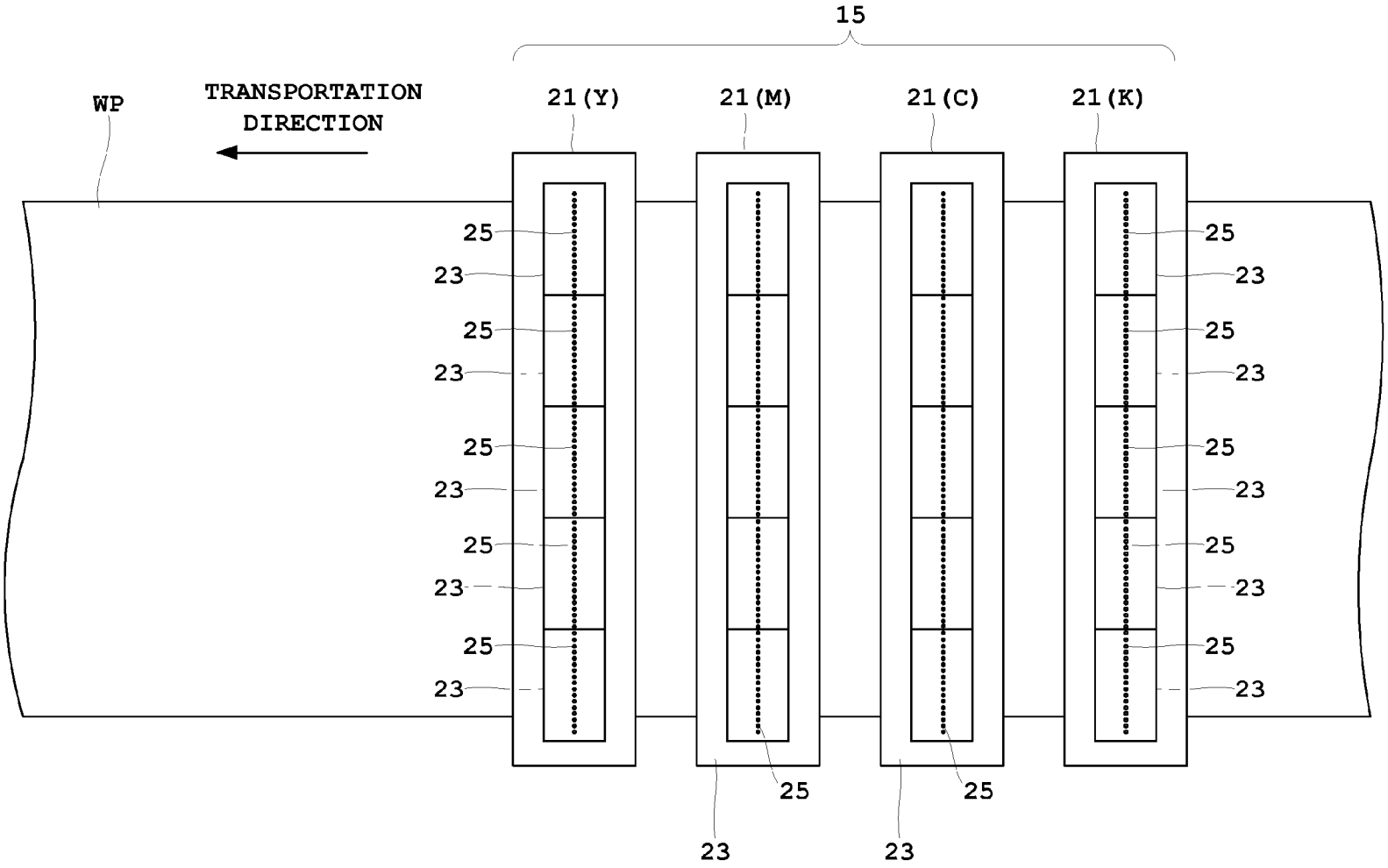
FIG. 2 is a schematic plan view of a printer.

FIG. 1 schematically illustrating an overall construction of an inkjet printing apparatus according to one embodiment. FIG. 2 is a schematic plan view of a printer.

The inkjet printing apparatus 1 according to the embodiment includes a paper feeder 3, a print unit 5, and a take-up roller 7.

The paper feeder 3 feeds web paper WP in a roll form. The print unit 5 of inkjet type performs printing by discharging ink droplets onto the web paper WP, thereby performing printing to the web paper WP. The take-up roller 7 winds up the printed web paper WP into a roll form.

The print unit 5 includes a drive roller 9 on an upstream side. The drive roller 9 takes in the web paper WP from the paper feeder 3. The web paper WP unwound from the paper feeder 3 by the drive roller 9 is transported downstream toward the take-up roller 7 along a plurality of transport rollers 11. A drive roller 13 is disposed between the most downstream transport roller 11 and the take-up roller 7. The drive roller 13 feeds the web paper WP travelling on the transport rollers 11 toward the take-up roller 7.

Between the drive rollers 9 and 13, the print unit 5 has a printer 15, a drying unit 17, and an inspecting unit 19 arranged in this order from upstream to downstream. The drying unit 17 dries a portion of the web paper WP printed with the printer 15. The inspecting unit 19 inspects the printed portion for any stains or omissions.

The printer 15 includes a plurality of printing heads 21 configured to discharge ink droplets. Here, four printing heads 21 are arranged by given intervals in a transportation direction of the web paper WP. The four printing heads 21 are, for example, provided for performing printing in different colors. In this embodiment, four printing heads 21 for black (K), cyan (C), magenta (M), and yellow (Y) are provided. Each of the printing heads 21 includes a plurality of recording modules 23. The recording modules 23 each have a printing width sufficient to perform printing without moving a printing area of the web paper WP in a width direction (in a direction perpendicular to the plane of FIG. 1). In other words, the printer 15 of the print unit 5 in the embodiment performs printing to the web paper WP without moving for primary scanning in a direction orthogonal to the transportation direction of the web paper WP while being fixed and feeding the web paper WP to a position where secondary scanning is conducted. Here, when the printing heads 21 need to be identified for every color in the following description, the printing head 21 for black is to be denoted by a printing head 21K, the printing head 21 for cyan by a printing head 21C, the printing head 21 for magenta by a printing head 21M, and the printing head 21 for yellow by a printing head 21Y.

As illustrated in FIG. 2, each of the printing heads 21 includes five recording modules 23. The recording modules 23 are arranged linearly so as a longitudinal direction thereof to correspond to the width direction of the web paper WP. Moreover, each of the recording modules 23 includes a train 25 of recording devices in column or linearly. In the embodiment, the train 25 of recording devices is adopted as a plurality of discharge ports of the ink droplets.

The controller 31 controls en bloc transportation of the drive rollers 9, 13, discharge of the ink droplets with the printer 15, drying with the drying unit 17, and inspection with the inspecting unit 19. The controller 31 is constituted by a CPU, a memory, and the like. The controller 31 is connected to a storing unit 33 configured to store information.

The controller 31 controls the printer 15 and the drive rollers 9, 13 to print the correcting chart onto the web paper WP. The controller 31 controls the inspecting unit 19 to read the chart for adjustment and analyze a scanned image thereof. Consequently, the correction data for correcting a discharge timing and the like from the printer 15 is calculated. Then, the discharge timing is adjusted in accordance with the correction data upon printing pf product. This achieves accurate printing onto the web paper WP.

Here, the printer 15 corresponds to the "printer" in the present invention. The inspecting unit 19 corresponds to the "scanner" in the present invention. The printing head 21 corresponds to the "line head" in the present invention. The controller 31 corresponds to the "correcting-chart printing unit", the "correction-data calculating device", and the "adjusting device" in the present invention.

Figure 3:
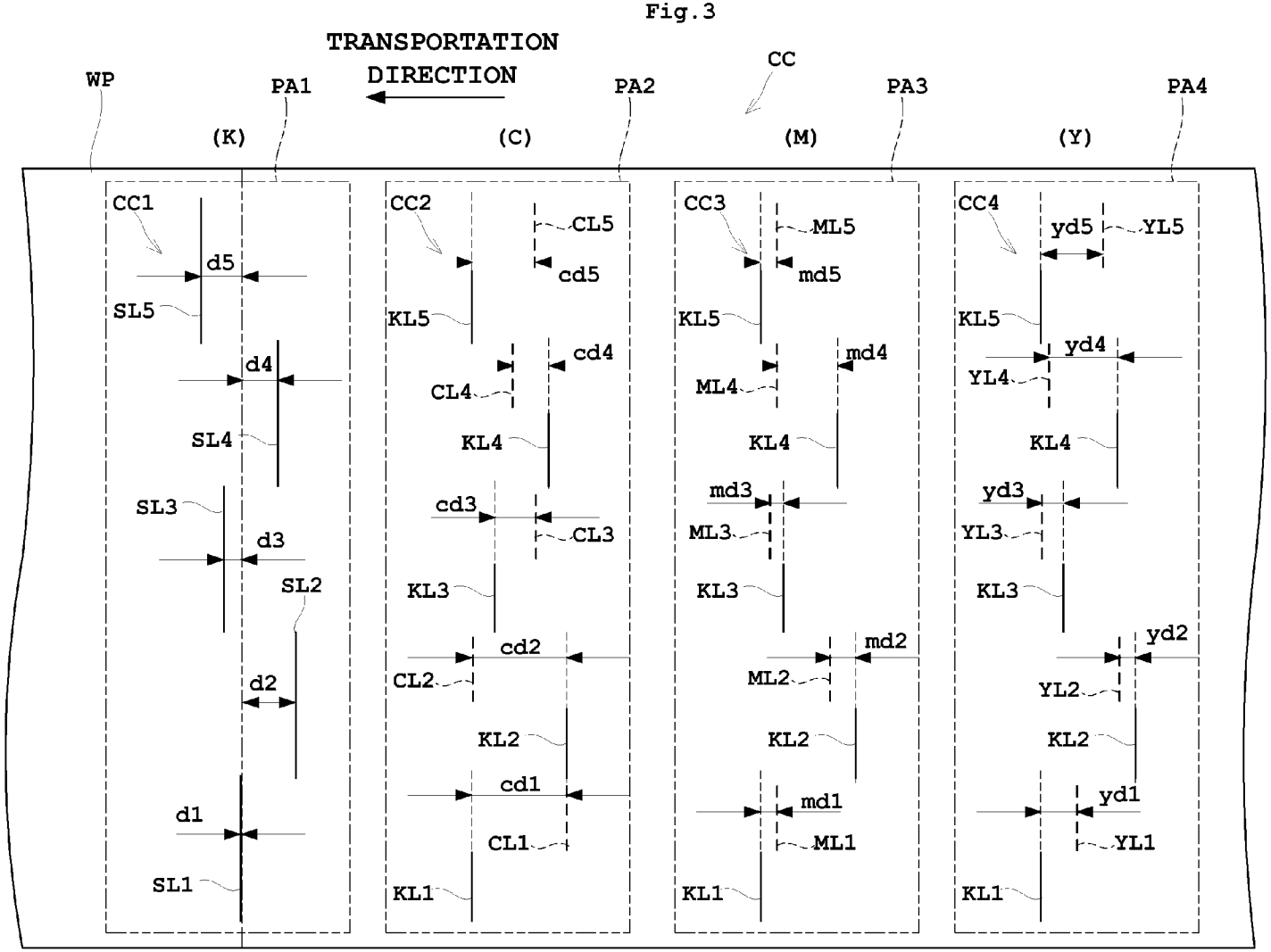
FIG. 3 is a schematic view of one example of a correcting chart.

Now the correcting chart is to be described with reference to FIG. 3. FIG. 3 is a schematic view illustrating one example of the correcting chart.

The controller 31 controls the printer 15 and the drive rollers 9, 13 to print a correcting chart CC as illustrated in FIG. 3 onto the web paper WP. The correcting chart CC has first to fourth line head areas PA1 to PA4 spaced away from one another in the transportation direction so as not to overlap. The first line head area PA1 has a first correcting chart CC1 printed with the printing head 21K for black. The second line head area PA2 has a second correcting chart CC2 printed with the printing head 21K for black and a printing head 21C for cyan. The third line head area PA3 has a third correcting chart CC3 printed with the printing head 21K for black and a printing head 21M for magenta. The fourth line head area PA4 has a fourth correcting chart CC4 printed with the printing head 21K for black and a printing head 21Y for yellow.

Here, the first to fourth line head areas PA1 to PA4 correspond to the "line head printing area" in the present invention.

In the first correcting chart CC1, trains 25 of recording devices of five recording modules 23 in the printing head 21K for black draw lines SL1 to SL5, respectively, in the width direction of the web paper WP at the same timing. One line should be drawn in the width direction upon discharge at the same timing. Actually, as illustrated in the drawing, step shift occurs due to assembly error of the recording modules 23 to the printing head 21, and thus no line is generated. In the second correcting chart CC2, trains 25 of recording devices of five recording modules 23 in the printing head 21K for black draw lines KL1 to KL5, respectively, in the width direction of the web paper WP at the same timing. Similarly trains 25 of recording devices of five recording modules 23 in the printing head 21C for cyan draw lines CL1 to CL5, respectively, in the width direction of the web paper WP at the same timing.

In the third correcting chart CC3, similar to the second correcting chart CC2, the printing head 21K for black draws lines KL1 to KL5, and the printing head 21M for magenta draws lines ML1 to ML5. In the fourth correcting chart CC4, the printing head 21K for black draws lines KL1 to KL5, and the printing head 21Y for yellow draws lines YL1 to YL5.

Here, the second to fourth correcting charts CC2 to CC4 contain lines, other than the line KL1 to KL5 by the printing head for black, represented by dotted lines. This helps distinction of the lines KL1 to 5 by the printing head for black in FIG. 3. Actually, lines other than the lines by the printing head for black are drawn similarly to the lines SL1 to SL5 and KL1 to KL5. However, with a construction having only the printing heads 21 for printing in the same color, it is preferable to perform the printing with different types of lines. In addition, with the construction having only the printing heads 21 for printing in the same color, identification markings may be printed in the transportation direction at boundaries of the lines for every printing head 21, thereby identifying the lines for every printing head 21.

Moreover, in the second to fourth correcting charts CC2 to CC4, the lines KL1 to KL5 by the printing head for black have a length substantially half the lines SL1 to SL5 by the printing head for black, respectively, in the first correcting chart CC1. In addition, in the second to fourth correcting charts CC2 to CC4, the lines other than those by the printing head for black have a length half the black lines SL1 to SL5 by the printing head for black, respectively, in the first correcting chart CC1. This is for eliminating difficulty in identifying the lines due to overlapping upon determining the difference in the transportation direction in the second to fourth correcting charts CC2 to CC4.

As illustrated in FIG. 3, the inspecting unit 19 scans the printed correcting chart CC to obtain a similar scanned image. Specifically, the first correcting chart CC1 is collected as a first scanned image, the second correcting chart CC2 as a second scanned image, the third correcting chart CC3 as a third scanned image, and the fourth correcting chart CC4 as a fourth scanned image. The scanned images obtained in this manner are collected in the storing unit 33, and are analyzed with the controller 31. Thereafter, as illustrated in FIG. 3, the line SL1 by the recording module 23 is regarded as a reference (reference line figure), the line SL1 being located at the left end in the first correcting chart CC1 (i.e., the bottom in FIG. 3). The differences d1 to d5 in the transportation direction between the line SL1 and the lines SL1 to SL5, respectively, is determined as reference head differences. Note that the difference d1 is zero because it is between the line SL1 itself.

Next, a difference cd1 between the black line KL1 and the cyan line CL1 is determined, the line KL1 being generated by the recording module 23 on the left end of the second correcting chart CC2. Similarly, a difference cd2 between the black line KL2 and the cyan line CL2, a difference cd3 between the black line KL3 and the cyan line CL3, and a difference cd4 between the black line KL4 and the cyan line CL4 are each determined.

Similarly, differences md1 to md5 in the third correcting chart CC3 are each determined, and differences yd1 to yd5 in the fourth correcting chart CC4 are each determined.

The differences d1 to d5 (the reference head differences), and the differences cd1 to cd5, md1 to md5, and yd1 to yd5 (individual head differences) are stored in the storing unit 33. The differences d1 to d5 are not changed and regarded as the correction data of the printing head 21K for black. Moreover, the sum of the differences d1 to d5 and the differences cd1 to cd5, being located in a position corresponding to each other, respectively, are regarded as correction data of the printing head 21C for cyan. The sum of the differences d1 to d5 and the differences md1 to md5, being located in a position corresponding to each other, respectively, are regarded as correction data of the printing head 21M for magenta. The sum of the differences d1 to d5 and the differences yd1 to yd5, being located in a position corresponding to each other, respectively, are regarded as correction data of the printing head 21Y for yellow. The correction data is stored in the storing unit 33. The controller 31 calls the correction data upon printing to use it for correction.

Figure 4:
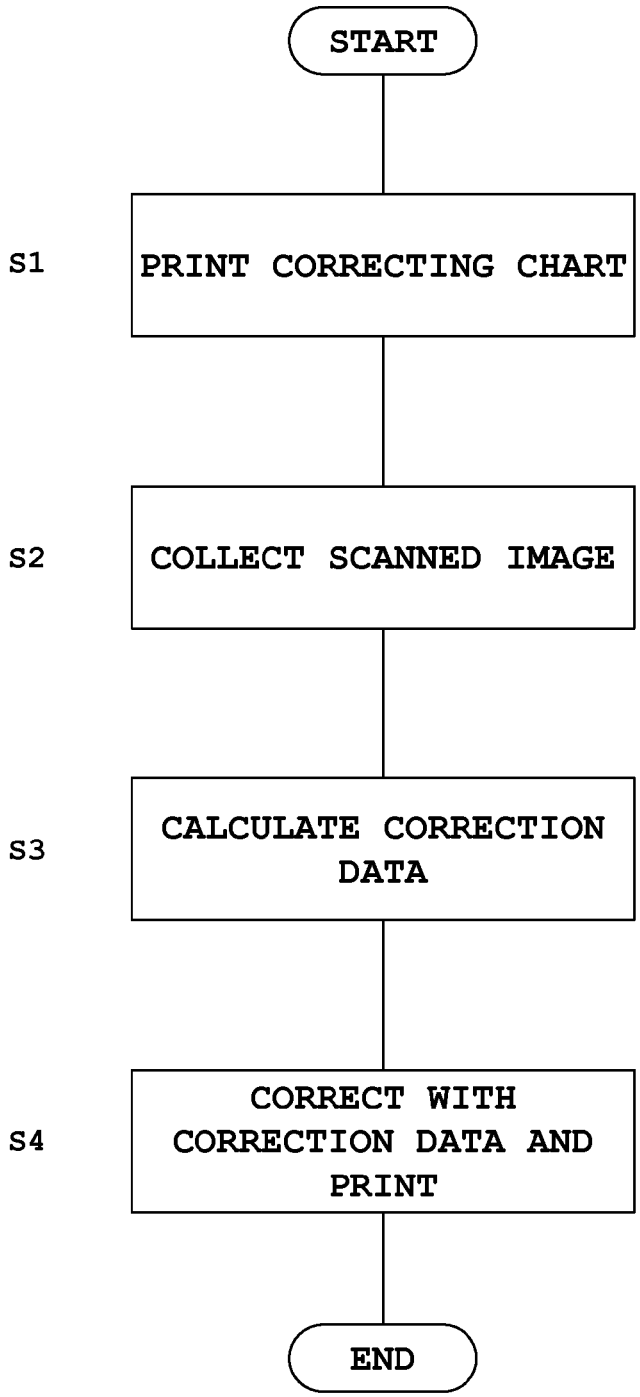
FIG. 4 is a flow chart of operation.

The following describes operation of the inkjet printing apparatus 1 with reference to FIG. 4. FIG. 4 is a flow chart of the operation.

Step S1

The controller 31 performs control to print the correcting chart CC as in FIG. 3 onto the web paper WP.

Step S2

The controller 31 controls the inspecting unit 19 to scan the correcting chart CC to collect a scanned image.

Step S3

As noted above, the controller 31 calculates the correction data (differences d1 to d5) of the printing head 21K for black, the correction data (the sum of the differences d1 to d5 and the differences cd1 to cd5 in the corresponding position, respectively) of the printing head 21C for cyan, the correction data (the sum the differences d1 to d5 and the differences md1 to md5 in the corresponding position, respectively) of the printing head 21M for magenta, and the correction data (the sum of the differences d1 to d5 and the differences yd1 to yd5 in the corresponding position, respectively) of the printing head 21Y for yellow. The correction data is stored in the storing unit 33.

Step S4

The controller 31 reads out the correction data in the storing unit 33, and performs printing while performing correction.

In the embodiment of the present invention, the controller 31 performs control so as to print the correcting charts CC in the first to fourth line head areas PA1 to PA4, and collects the charts as scanned images. Then, the controller 31 determines the differences d1 to d5, the differences cd1 to cd5, the differences md1 to md5, and the differences yd1 to yd5. Thereafter, the controller 31 calculates the sum of the differences in the corresponding positions. The differences d1 to d5 are regarded as the correction data of the printing head 21K for black, and the sum of the differences in the corresponding positions is each regarded as the correction data of the printing head 21C, 21M, and 21Y for cyan, magenta, yellow, respectively. The controller 31 controls the timing in accordance with the correction data upon printing with the printer 15. Consequently, the correction data is obtainable with one-time printing. This achieves an enhanced acquiring efficiency of the correction data.

This invention is not limited to the foregoing examples, but may be modified as follows.

Figure 5:
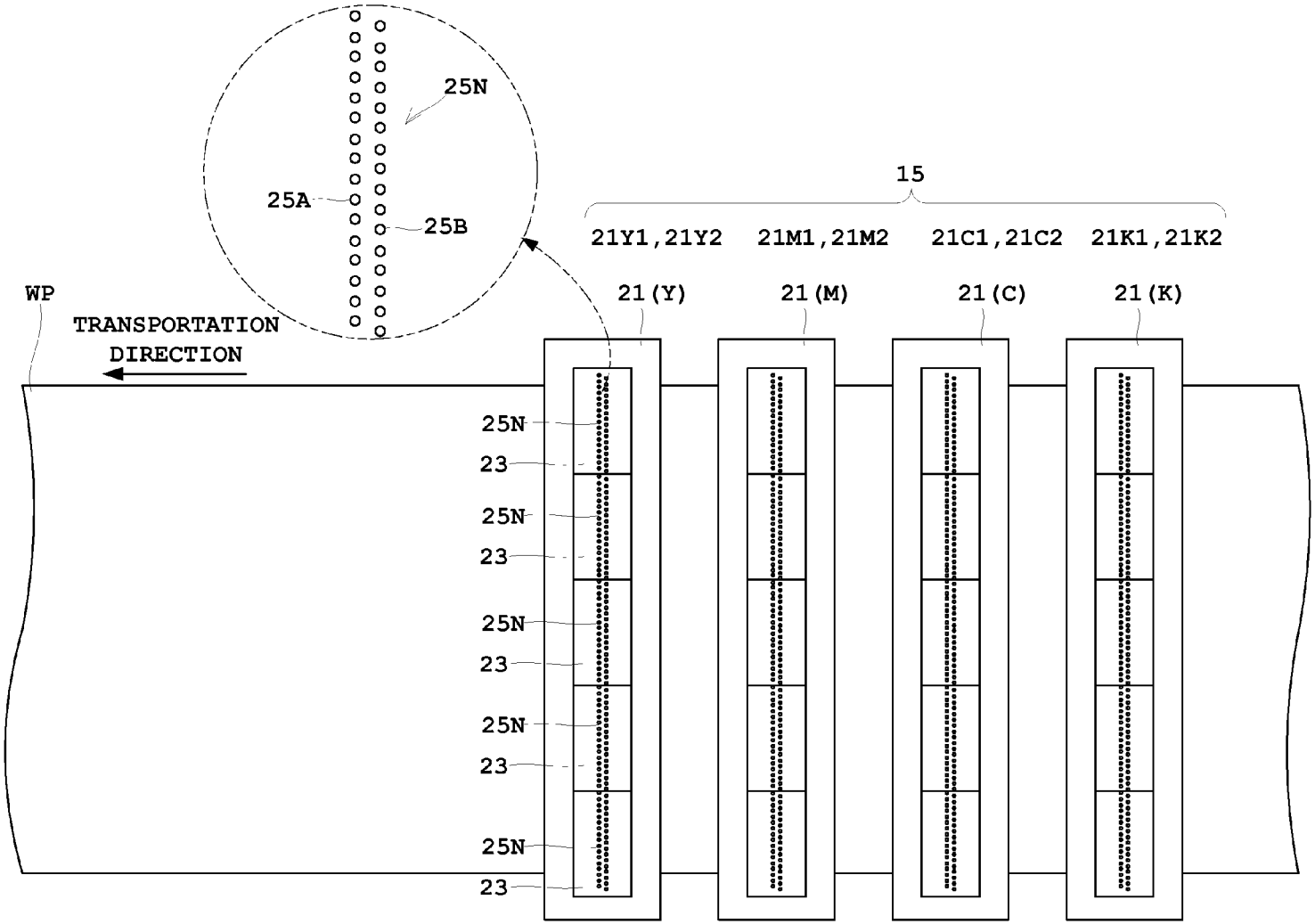
FIG. 5 is a schematic plan view of a printer according to one modification.
Figure 6:
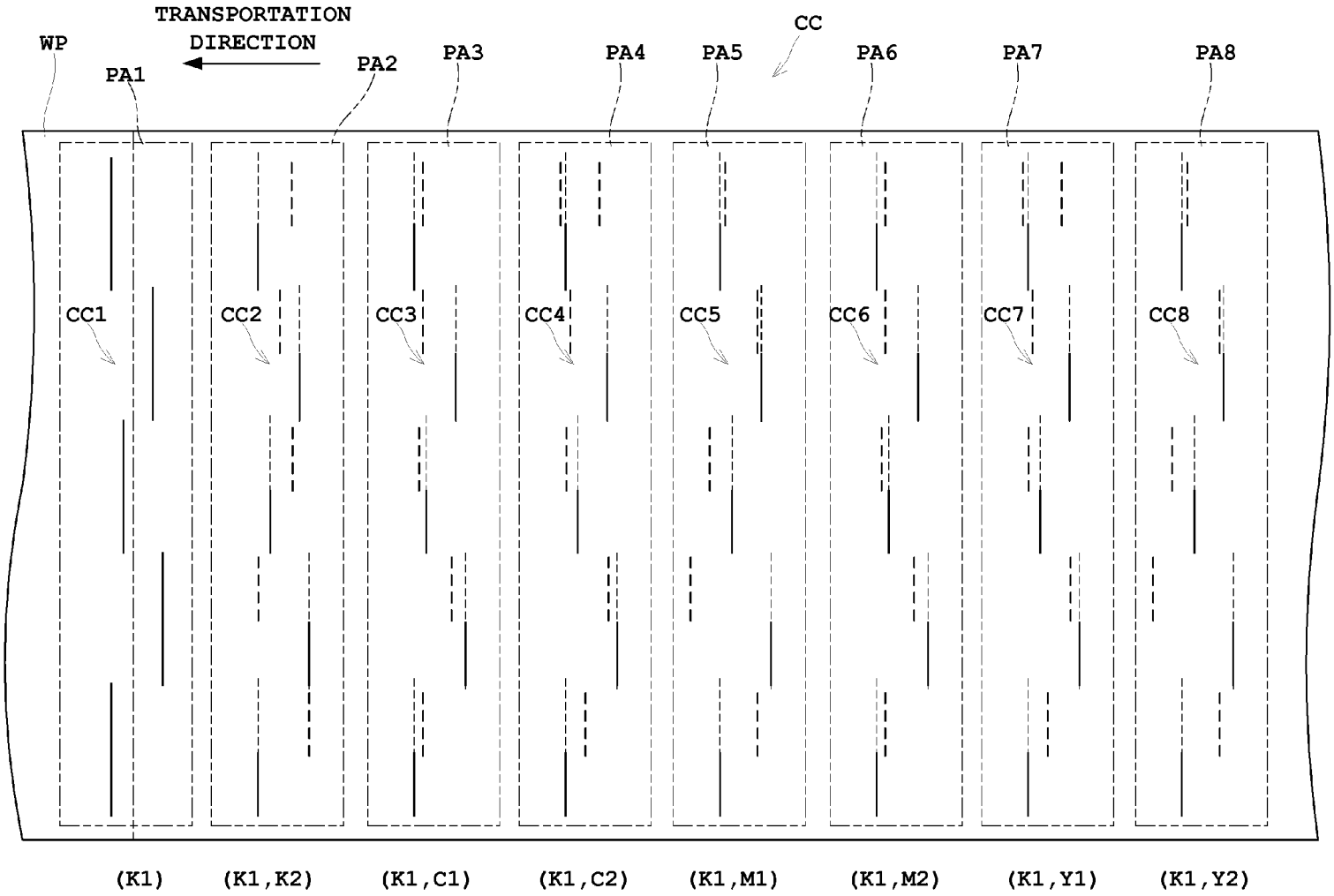
FIG. 6 is a schematic view of one example of a correcting chart according to the modification.

(1) The embodiment mentioned above adopts one train 25 of the recording devices in the recording module 23 of the printing head 21. However, the present invention is not limited to such a construction. For instance, as illustrated in FIG. 5, the present invention is applicable to a construction with recording devices 25N constituted by two trains 25A and 25B of recording devices. In this case, a correcting chart CC as illustrated in FIG. 6 may be printed for calculating correction data. Here, FIG. 5 illustrates a schematic plan view of a printer according to one modification. FIG. 6 is a schematic view of one example of the correcting chart with the modification.

In such a construction, the train 25A of the recording devices in the printing head 21K for black is regarded as a printing head 21K1, and the train 25B of the recording devices is regarded as a printing head 21K2. In addition, the train 25A of the recording device in the printing head 21C for cyan is regarded as a printing head 21C1, and the train 25B of the recording device in the printing head 21C for cyan is regarded as a printing head 21C2. Similarly, the trains 25A and 25B in the printing head 21M for magenta are regarded as printing heads 21M1 and 21M2, respectively. The trains 25A and 25B in the printing head 21Y for yellow are regarded as printing heads 21Y1 and 21Y2, respectively.

The correcting chart CC is constituted by the correcting charts CC1 to CC8. In this embodiment, each chart is drawn based on the printing head 21K1 for black. Specifically, the correcting chart CC1 is drawn with the printing head 21K1 for black. The correcting chart CC2 is drawn with the printing head 21K1 for black and the printing head 21K2 for black. The correcting chart CC3 is drawn with the printing head 21K1 for black and the printing head 21C1 for cyan. The correcting chart CC4 is drawn with the printing head 21K1 for black and the printing head 21C2 for cyan. The correcting chart CC5 is drawn with the printing head 21K1 for black and the printing head 21M1 for magenta. The correcting chart CC6 is drawn with the printing head 21K1 for black and the printing head 21M2 for magenta. The correcting chart CC7 is drawn with the printing head 21K1 for black and the printing head 21Y1 for yellow. The correcting chart CC8 is drawn with the printing head 21K1 for black and the printing head 21Y2 for yellow.

Then, the difference in the correcting chart CC1 is regarded as the correction data of the printing head 21K1 for black. The sum of the difference in the correcting chart CC1 and the differences in the correcting charts CC2 to CC8 each in the corresponding position is regarded as the correction data of the printing head 21K2 for black, the correction data of the printing heads 21C1, C2 for cyan, the correction data of the printing heads 21M1, M2 for magenta, and the correction data of the printing heads 21Y1, Y2 for yellow, respectively. Determining the correction data in this manner achieves application of the present invention to the construction such a printing head 21 having two trains 25N of the recording devices.

(2) In the embodiment mentioned above, the web paper WP is adopted as the print medium. However, the present invention is not limited to the print medium. For instance, examples of the print medium include a film and printing paper in a sheet form.

(3) In the embodiment mentioned above, the printer 15 is constituted by four printing heads 21 for black, magenta, cyan, and yellow. Alternatively, the present invention is applicable to an apparatus including at least two printing heads 21. Moreover, the printing head is not limited to one for color printing. For instance, a construction having two or more printing heads 21 for black is applicable.

(4) In the embodiment mentioned above, the inkjet printing apparatus 1 has been described as one example of the printing apparatus. However, the present invention is not limited to the inkjet apparatus.

(5) In the embodiment mentioned above, it is preferable that lines are printed in the second to fourth line head areas PA2 to PA4.

Figure 7:
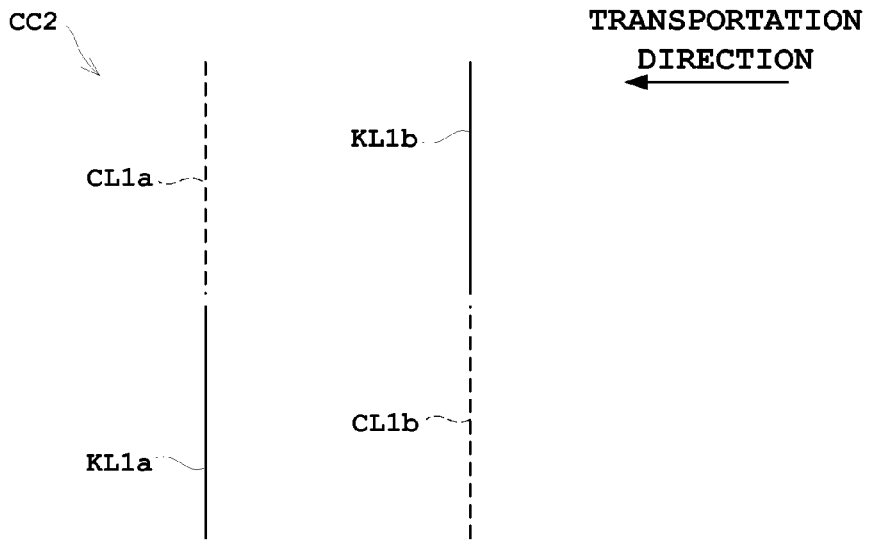
FIG. 7 is a schematic view of another example of printing the correcting chart.

For instance, as illustrated in FIG. 7, line figures are printed in the second line head area PA2 so as to be spaced away in the transportation direction with a portion (KL1*b*, CL1*b*), other than a portion (KL1*a*, CL1*a*) of the recording module 23, that is used upon prior printing of the line figures. Then, the controller 31 calculates the difference of the printing head 21C for cyan by averaging step shift in the second line head area PA2 determined from the line figures KL1*a* CL1*a* and the line figures KL1*b*, CL1*b*, respectively.

Figure 8:
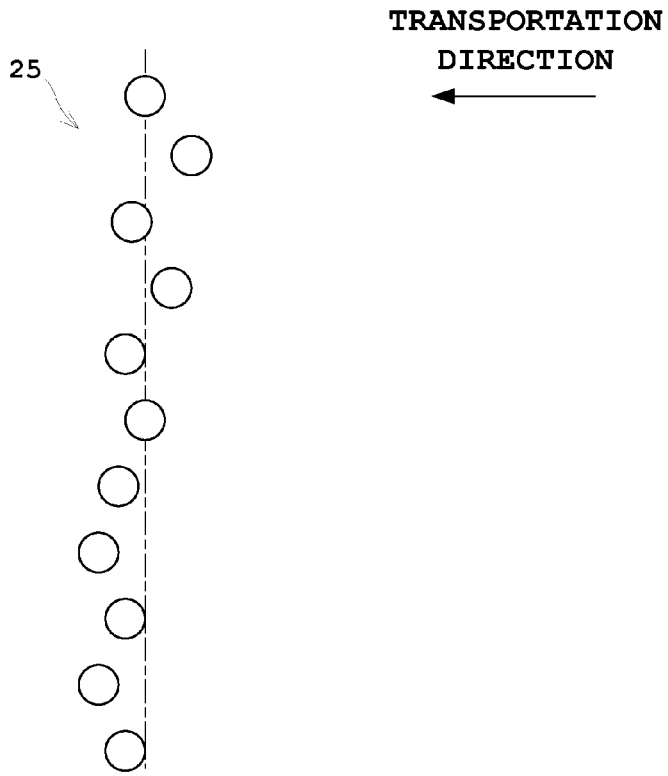
FIG. 8 is a schematic view of shifting of a train of recording devices.

As illustrated in FIG. 8, the train 25 of the recording devices is not linear in the width direction due to machining accuracy, and typically shifted in the transportation direction of the web paper WP. Consequently, when the individual head difference is determined from the difference in the transportation direction between the first correcting chart and the second correcting chart printed with the train 25 of recording devices in a part of the recording module 23, an error due to the shifting may possibly increase. Accordingly, both the differences in the transportation direction are averaged to obtain the result as the individual head difference. Here, the differences are between the first correcting chart and the second correcting chart printed with the train 25 of the recording devices in a part of the recording module 23, and between the first correcting chart and the second correcting chart each printed with the train 25 of the recording devices in the remaining part of the recording module 23 This achieves a suppressed influence of the error due to the shifting. Consequently, the accurate individual head difference is obtainable.

The present invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus configured to perform printing to a print medium, the printing apparatus comprising:

a printer having at least two line heads spaced away in a transportation direction of the print medium, the line heads each having a plurality of recording modules with a train of recording devices arranged linearly in a width direction of the print medium;

a scanner configured to scan an image printed with the printer to obtain a scanned image;

a correcting-chart printing unit configured to cause a first line head of the printer to print a first correcting chart in a first line head printing area, and cause a second line head to print a second correcting chart in a second line head printing area, away from the first line head printing area in the transportation direction, said recording modules being arranged in a width direction of the print medium so that line figures printed by the recording modules of the first line head, and line figures printed by the recording modules of the second line head, that are printed at the same position in the transportation direction, do not overlap each other;

a scanned image collecting unit configured to operate the scanner to read the first line head printing area and the second line head printing area to collect a first scanned image and a second scanned image, respectively;

a correction-data calculating device configured to calculate correction data, the correction-data calculating device regarding a line figure in the first scanned image formed with one of the plurality of recording modules as a reference line figure, and determining a difference in the transportation direction between the reference line figure and a line figure formed with the other recording module as a reference head difference, determining a difference in the transportation direction between a first line figure and a second line figure of the second scanned image as an individual head difference, the first line figure being formed with the first line head and the second line figure being formed with the second line head, and summing up the reference head difference and the individual head difference to obtain a total for every recording module, the reference head difference being regarded as the correction data in the transportation direction for every recording module in the first line head, and the total being regarded as the correction data for every recording module in the second line head; and an adjusting device configured to adjust a timing in accordance with the correction data upon printing with the printer.

2. The printing apparatus according to claim 1, wherein the first line head of the printer performs printing prior to the second line head.

3. The printing apparatus according to claim 1, wherein the reference line figure is printed with one of the plurality of recording modules that performs first printing.

4. The printing apparatus according to claim 1, wherein the first line head of the printer performs printing in black (K).

5. The printing apparatus according to claim 1, wherein when the recording module includes a plurality of trains of recording devices, each of the trains of recording devices subsequent to the second train in the first line head is regarded as the second line head.

6. A printing apparatus configured to perform printing to a print medium, the printing apparatus comprising:

a printer having at least two line heads spaced away in a transportation direction of the print medium, the line heads each having a plurality of recording modules with a train of recording devices arranged linearly in a width direction of the print medium;

a scanner configured to scan an image printed with the printer to obtain a scanned image;

a correcting-chart printing unit configured to cause a first line head of the printer to print a first correcting chart in a first line head printing area and cause a second line head to print a second correcting chart in a second line head printing area, away from the first line head printing area in the transportation direction;

a scanned image collecting unit configured to operate the scanner to read the first line head printing area and the second line head printing area to collect a first scanned image and a second scanned image, respectively;

a correction-data calculating device configured to calculate correction data, the correction-data calculating device regarding a line figure in the first scanned image formed with one of the plurality of recording modules as a reference line figure, and determining a difference in the transportation direction between the reference line figure and a line figure formed with the other recording module as a reference head difference, determining a difference in the transportation direction between a first line figure and a second line figure of the second scanned image as an individual head difference, the first line figure being formed with the first line head and the second line figure being formed with the second line head, and summing up the reference head difference and the individual head difference to obtain a total for every recording module, the reference head difference being regarded as the correction data in the transportation direction for every recording module in the first line head, and the total being regarded as the correction data for every recording module in the second line head; and an adjusting device configured to adjust a timing in accordance with the correction data upon printing with the printer;

wherein the correcting-chart printing unit performs printing of the line figure of the first correcting chart for every recording module and the line figure of the second correcting chart for every recording module in the second line head printing area by a length in the width direction of the print medium such that the line figures printed at the same position in the transportation direction do not overlap each other;

the correcting-chart printing unit prints the line figures of the first correcting chart and the second correcting chart in the second line head printing area so as to be spaced away from each other in the transportation direction with a portion other than the recording module used upon printing the line figures; and the correction-data calculating device calculates the individual head difference by averaging step shift, the step shift being determined from the line figures of the first and second correcting charts in the second line head printing area for every recording module.

7. The printing apparatus according to claim 6, wherein the first line head of the printer performs printing prior to the second line head.

8. The printing apparatus according to claim 6, wherein the reference line figure is printed with one of the plurality of recording modules that performs first printing.

9. The printing apparatus according to claim 6, wherein the first line head of the printer performs printing in black (K).

10. A method of correcting step shift of a printing apparatus configured to perform printing to a print medium, the method comprising:

a correcting-chart printing step of printing a first correcting chart with a first line head of a printer in a first line head printing area and printing in a second line head printing area, spaced away from the first line head printing area in a transportation direction, a second correcting chart with a second line head, the line heads each having a plurality of recording modules with a train of recording devices arranged linearly in a width direction of the print medium;

said recording modules being arranged in a width direction of the print medium so that line figures printed by the recording modules of the first line head, and line figures printed by the recording modules of the second line head, that are printed at the same position in the transportation direction, do not overlap each other;

a scanned-image collecting step of reading the first line head printing area and the second line head printing area to collect a first scanned image and a second scanned image, respectively;

a correction-data calculating step of calculating correction data by regarding a line figure in the first scanned image formed with one of the plurality of recording modules as a reference line figure and determining a difference in the transportation direction between the reference line figure and another line figure formed with the other recording module as a reference head difference, determining a difference in the transportation direction between a first line figure and a second line figure of the second scanned image formed with the first line head and the second line head, respectively as an individual head difference, and summing up the reference head difference and the individual head difference to obtain a total for every recording module, the reference head difference being regarded as the correction data in the transportation direction for every recording module in the first line head, and the total being regarded as the correction data for every recording module in the second line head; and an adjusting step of adjusting a timing in accordance with the correction data upon printing with the printer.

* * * * *